US011318972B2

(12) United States Patent
Jovenall

(10) Patent No.: US 11,318,972 B2
(45) Date of Patent: May 3, 2022

(54) SYSTEMS AND METHODS FOR CONTROLLING MOVEMENT OF LOCOMOTIVES

(71) Applicant: Cattron North America, Inc., Warren, OH (US)

(72) Inventor: Jeremy Jovenall, Mercer, PA (US)

(73) Assignee: CATTRON NORTH AMERICA, INC., Warren, OH (US)

( * ) Notice: Subject to any disclaimer, the term of this patent is extended or adjusted under 35 U.S.C. 154(b) by 516 days.

(21) Appl. No.: 16/534,576

(22) Filed: Aug. 7, 2019

(65) Prior Publication Data

US 2021/0039693 A1 Feb. 11, 2021

(51) Int. Cl.

| | |
|---|---|
| ***B61L 27/16*** | (2022.01) |
| ***B61L 23/34*** | (2006.01) |
| ***B61L 27/04*** | (2006.01) |
| ***B61L 27/40*** | (2022.01) |

(52) U.S. Cl.

CPC ..... *B61L 27/16* (2022.01); *B61L 23/34* (2013.01); *B61L 27/04* (2013.01); *B61L 27/40* (2022.01)

(58) Field of Classification Search

CPC ..... B61L 27/16; B61L 27/40; B61L 3/127
See application file for complete search history.

(56) References Cited

U.S. PATENT DOCUMENTS 6,834,219 B2 * 12/2004 Proulx ..... B61L 3/127 701/19
6,853,890 B1 * 2/2005 Horst ..... B61C 17/12 701/19
6,853,900 B2 2/2005 Rapp et al.
7,203,228 B2 4/2007 Horst et al.
2005/0209777 A1 * 9/2005 Peltz ..... B61L 3/127 701/19

(Continued)

FOREIGN PATENT DOCUMENTS

WO WO-2005061297 A1 * 7/2005 ..... B61L 23/041

OTHER PUBLICATIONS

Accuspeed Remote Control System, https://www.cattron.com/transportation/accuspeed, accessed Sep. 10, 2019, 4 pages.

(Continued)

*Primary Examiner* — Michael J Zanelli
(74) *Attorney, Agent, or Firm* — Harness, Dickey & Pierce, P.L.C.; Anthony Fussner

(57) ABSTRACT

An example locomotive consist control system includes a locomotive controller located on a locomotive consist to control movement of the locomotive consist along one or more tracks, and a field operator control unit in communication with the locomotive controller. The field operator control unit is configured to control movement of the locomotive consist via the locomotive controller. The system also includes a yard supervisory controller configured to monitor a location of the locomotive consist along the one or more tracks, and a remote operator controller in communication with the yard supervisory controller and the locomotive controller. The remote operator controller is configured to transmit speed and direction orders from the yard supervisory controller to the locomotive controller to control movement of the locomotive consist.

20 Claims, 5 Drawing Sheets

(56) References Cited

U.S. PATENT DOCUMENTS

2017/0120939 A1* 5/2017 Paden ..... B61L 3/127

OTHER PUBLICATIONS

Accuspeed, Advanced Automatic Remote Speed Control for Locomotives, http://catalog.jamiesonequipment.com/Asset/Cattron-Laird-Remtron%20Accuspeed%20Brochure%20JEC.pdf, accessed Sep. 10, 2019, 4 pages.

RCL-II Locomotive Remote Control System Operating Instructions, http://cdn.lairdtech.com/home/brandworld/files/9M02-7564-A002.pdf, see sections 7.7.4, 7.7.4.1, and 7.7.4.2 on p. 64, 75 pages.

* cited by examiner

SYSTEMS AND METHODS FOR CONTROLLING MOVEMENT OF LOCOMOTIVES

FIELD

The present disclosure generally relates to systems and methods for controlling movement of locomotives.

BACKGROUND

This section provides background information related to the present disclosure which is not necessarily prior art.

Existing remote control locomotive (RCL) technology utilizes one or two operators in a switchyard acting as primary and secondary operators. The primary/secondary role may be switched so that the operator with the best vantage point has movement control as the primary operator, while the secondary operator has tilt monitoring, sounding device control, and emergency override control. In some cases, RCL systems include automatic point protection that permits a one-person field crew.

DRAWINGS

The drawings described herein are for illustrative purposes only of selected embodiments and not all possible implementations, and are not intended to limit the scope of the present disclosure.

Corresponding reference numerals indicate corresponding (though not necessarily identical) parts throughout the several views of the drawings.

DETAILED DESCRIPTION

Figure 1:
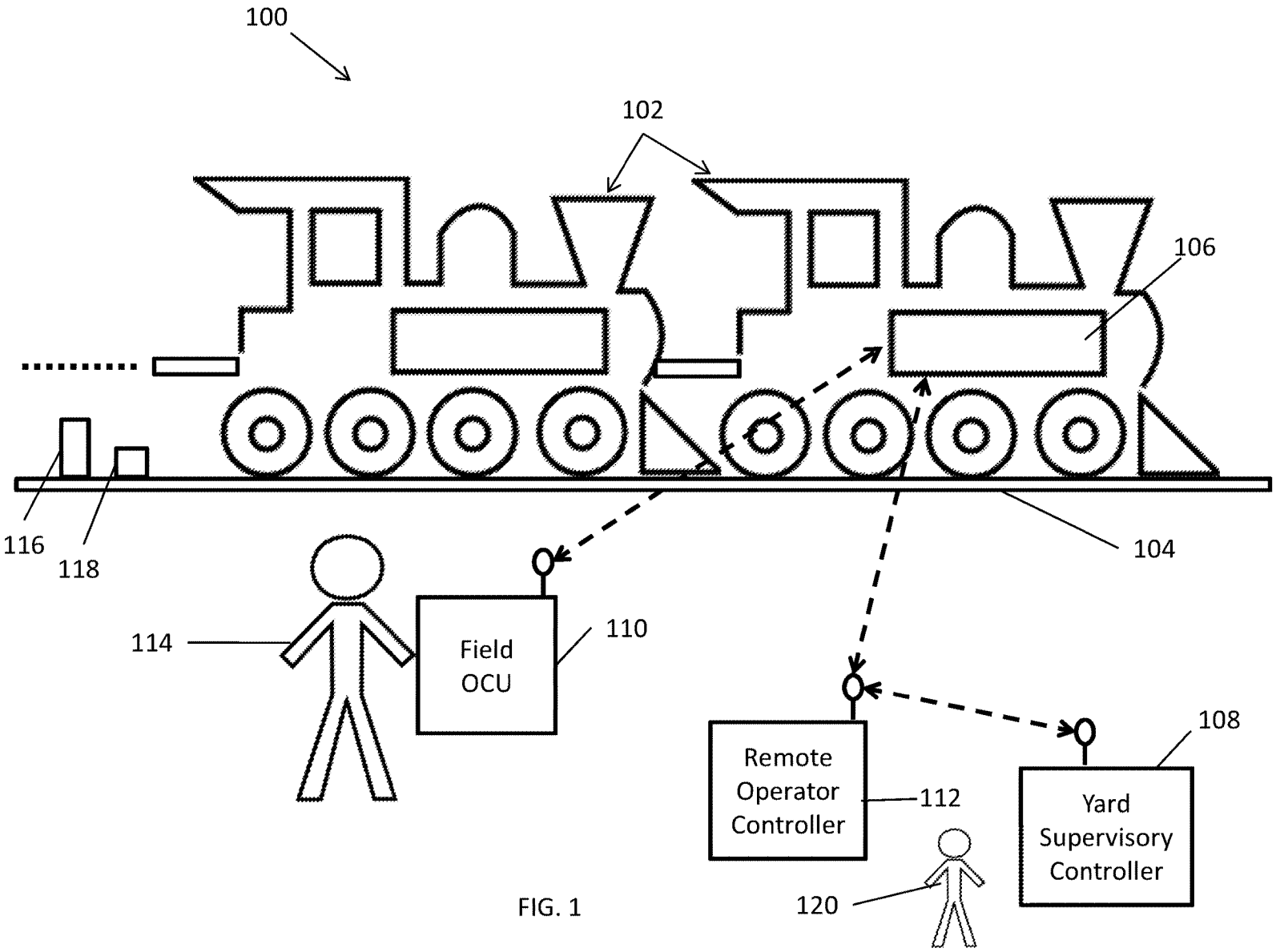
FIG. 1 is a diagram of a system for controlling movement of a locomotive, according to one example embodiment of the present disclosure.

Example embodiments will now be described more fully with reference to the accompanying drawings.

Existing remote control locomotive (RCL) technology utilizes one or two operators in a switchyard acting as primary and secondary operators. The primary/secondary role may be switched so that the operator with the best vantage point has movement control as the primary operator, while the secondary operator has tilt monitoring, sounding device control, and emergency override control. In some cases, RCL systems include automatic point protection that permits a one-person field crew.

In some example embodiments described herein, the roles of workers in the yard switching environment are changed to place one worker role in a safer location while improving the safety of the yard-based operator. For example, the traditional primary and secondary roles involved in yard switching may be changed from primary and secondary operators in the yard, to a remote (e.g., kiosk) operator and a field operator.

The remote operator may have remote control of track switches (e.g., via a remote operator controller, etc.), to plan a movement route for a locomotive consist, and to line the planned route accordingly. The remote operator may set a maximum stopping range for each movement, and may monitor a point of the locomotive consist, a location of one or more cars and/or locomotives in the locomotive consist, movement of the locomotive consist along one or more tracks, etc., via streaming video, etc.

A yard supervisory system may monitor (e.g., via a yard supervisory controller, etc.), a location of a head of the locomotive consist, a location of a tail of the locomotive consist, states of track switches along the one or more tracks, etc. In some embodiments, the yard supervisory controller may monitor a location of the field operator (e.g., a location of a field operator control unit, etc.), with respect to the planned route of the locomotive consist, may monitor states of axle counters positioned at specified locations along the one or more tracks (e.g., such as part of a track switch), etc.

The yard supervisory controller may be configured to access intelligent video systems, virtual track maps, dynamic consist makeup lists, other information, etc. The yard supervisory controller may transmit the planned route, a maximum speed of movement, an acceptable direction of movement, etc., to the locomotive controller (e.g., via the remote operator controller).

The yard supervisory controller may transmit an alert to the field operator control unit and/or the remote operator control unit if the yard supervisory controller detects a situation, condition, etc., that is determined to be a risk for the field operator or other equipment. For example, a detected risk condition may include the locomotive consist partially traversing a run-through switch that is misaligned, a field operator control unit operating outside of a specified acceptable movement range, etc.

The field operator control unit may allow the field operator to control locomotive consist movement initiation, to provide direction of movement confirmation, to control a speed limit of the locomotive consist, etc. The field operator control unit may include tilt protection, vigilance protection, may provide movement stop control and initiation of a spotting feature for coupling/uncoupling, etc.

One example role of the field operator is to authorize movement of the locomotive consist (e.g., via the field operator control unit), command a stop of the locomotive consist or wait for the yard supervisory controller to stop movement of the locomotive consist, and verify coupler alignment between the locomotive consist and one or more other rail cars and/or locomotives. The field operator may then use a spotting feature (e.g., via the field operator control unit), to make a joint when coupling, and then to stretch the joint.

When uncoupling cars from the locomotive consist, one example role of the field operator is to ride the lead car of the locomotive consist to the cutoff point, command a stop of the locomotive consist or wait for the yard supervisory controller to stop movement of the locomotive consist, set car handbrakes (e.g., as prescribed by local rules, etc.), authorize a reverse movement and pull a coupling pin.

In some embodiments, the locomotive controller (e.g., remote control locomotive equipment) receives maximum speed and acceptable direction orders from the yard supervisory controller through the remote operator controller, transmits an alert to the field operator control unit, and waits to receive a movement initiation command from the field operator control unit in order to execute the movement.

In some embodiments, one remote operator controller may facilitate route planning and navigation of multiple locomotive consists operated by multiple field operator control units. The remote operator control unit may be operated in a remote location through a network connection. The remote operator controller may not monitor streaming video of a pull movement point if automation systems such as intelligent video processing, pullback protection, etc. are implemented on a remote control locomotive system.

With reference to the Figures, FIG. 1 illustrates a locomotive consist control system 100 including a locomotive controller 106 located on a locomotive consist 102 to control movement of the locomotive consist 102 along one or more tracks 104. A field operator control unit 110 is in communication with the locomotive controller 106. The field operator control unit 110 is configured to control movement of the locomotive consist 102 via the locomotive controller 106.

The system 100 also includes a yard supervisory controller 108 configured to monitor a location of the locomotive consist 102 along the one or more tracks 104 (e.g., rail tracks, etc.), and a remote operator controller 112 in communication with the yard supervisory controller 108 and the locomotive controller 106. The remote operator controller 112 is configured to transmit speed and direction orders from the yard supervisory controller 108 to the locomotive controller 106, to control movement of the locomotive consist 102.

As illustrated in FIG. 1, the locomotive consist 102 includes two locomotives coupled together. The locomotives of the locomotive consist 102 may operate in tandem (e.g., by remote control, etc.), and may require electrical and pneumatic connections, in order to operate together. Although FIG. 1 illustrates the consist 102 as including two locomotives, other embodiments may include more or less locomotives in the consist 102. Optionally, one or more rail cars may be connected to the locomotive(s) of the consist 102.

Figure 2:
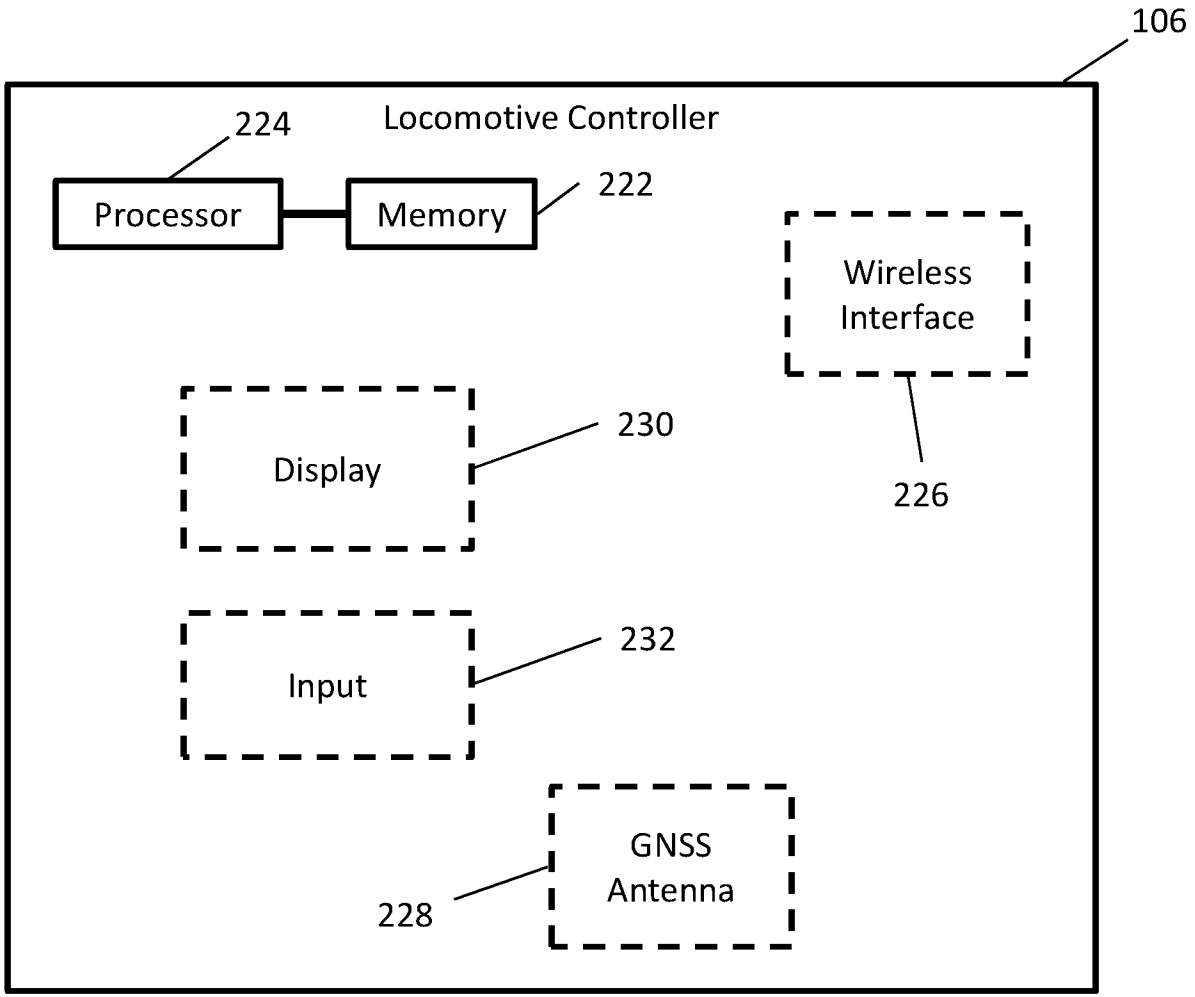
FIG. 2 is a block diagram of the locomotive controller of FIG. 1.

As mentioned above, the locomotive controller 106 (e.g., a remote control locomotive (RCL) controller, etc.) may be configured to control movement of the locomotive consist 102 along the track(s) 104 (e.g., via a tractive effort mechanism, via a pneumatic braking system, etc.). As shown in FIG. 2, the locomotive controller 106 may include a memory 222 configured to store computer executable instruction, and a processor 224 configured to execute the computer-executable instructions stored in memory 222.

The locomotive controller 106 may include one or more wireless interfaces 226 (e.g., data ports), such as a short-range wireless communication interface, a Wi-Fi wireless communication interface, a cellular communication interface, other radio frequency (RF) interfaces, etc.

The locomotive controller 106 may include a global navigation satellite system (GNSS) antenna 228 (e.g., a GPS antenna, etc.), one or more accelerometers (e.g., an accelerometer array, a single accelerometer, etc.), etc. The locomotive controller 106 can report a location, one or more parameters, etc. to the field operator control unit 110, the yard supervisory controller 108 (e.g., via the remote operator controller 112), etc.

The locomotive controller 106 may include an optional display 230 and an input 232. The optional display 230 can be any suitable display (e.g., a liquid crystal display (LCD), light emitting diodes (LED), indicator lights, etc.). The input 232 can include any suitable input element(s) (e.g., a keypad, touchscreen, switches, etc.), for receiving inputs (e.g., commands, etc.) from an operator.

The track(s) 104 may include at least one track switch 116, and the remote operator controller 112 may be configured to control the track switch 116 to plan and line a route for movement of the locomotive consist 102 along the track(s) 104. For example, the remote operator controller 112 may be configured to set a maximum stopping range for each movement of the locomotive consist 102 (e.g., via an input from a remote operator 120, etc.).

Figure 3:
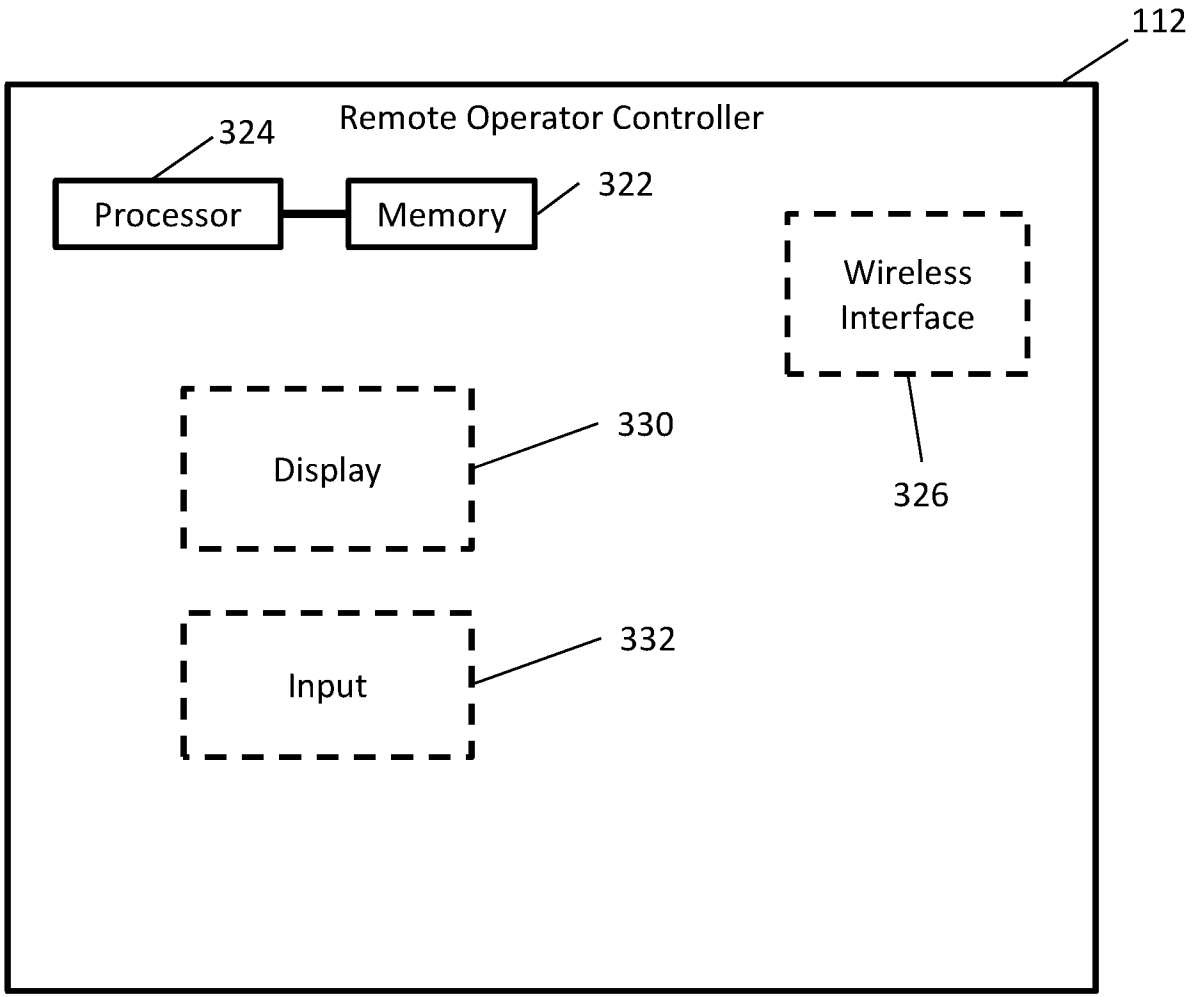
FIG. 3 is a block diagram of the remote operator controller of FIG. 1.

As shown in FIG. 3, the remote operator controller 112 may include a display 330. The remote operator controller 112 may be configured to receive and display a streaming video feed to monitor movement of the consist 102 along the track(s) 104. For example, the remote operator controller may include a wireless interface 326 (and/or a wired interface) for receiving the streaming video feed. The remote operator controller 112 may include a memory 322, a processor 324, and an input 332.

Referring back to FIG. 1, the locomotive consist 102 may include a head (e.g., a locomotive located at a head of the consist 102, etc.), and a tail (e.g., a locomotive located at a tail of the consist 102, etc.). The yard supervisory controller 108 may be configured to monitor a location of the head of the locomotive consist 102, a location of the tail of the locomotive consist 102, a state of the track switch 116, etc.

The track(s) 104 may include at least one axle counter 118 positioned at a location on the track(s) 104. The yard supervisory controller 108 may be configured to monitor a location of the field operator control unit 110 with respect to a planned route of movement of the locomotive consist 102, a state of the at least one axle counter 118, etc.

Figure 4:
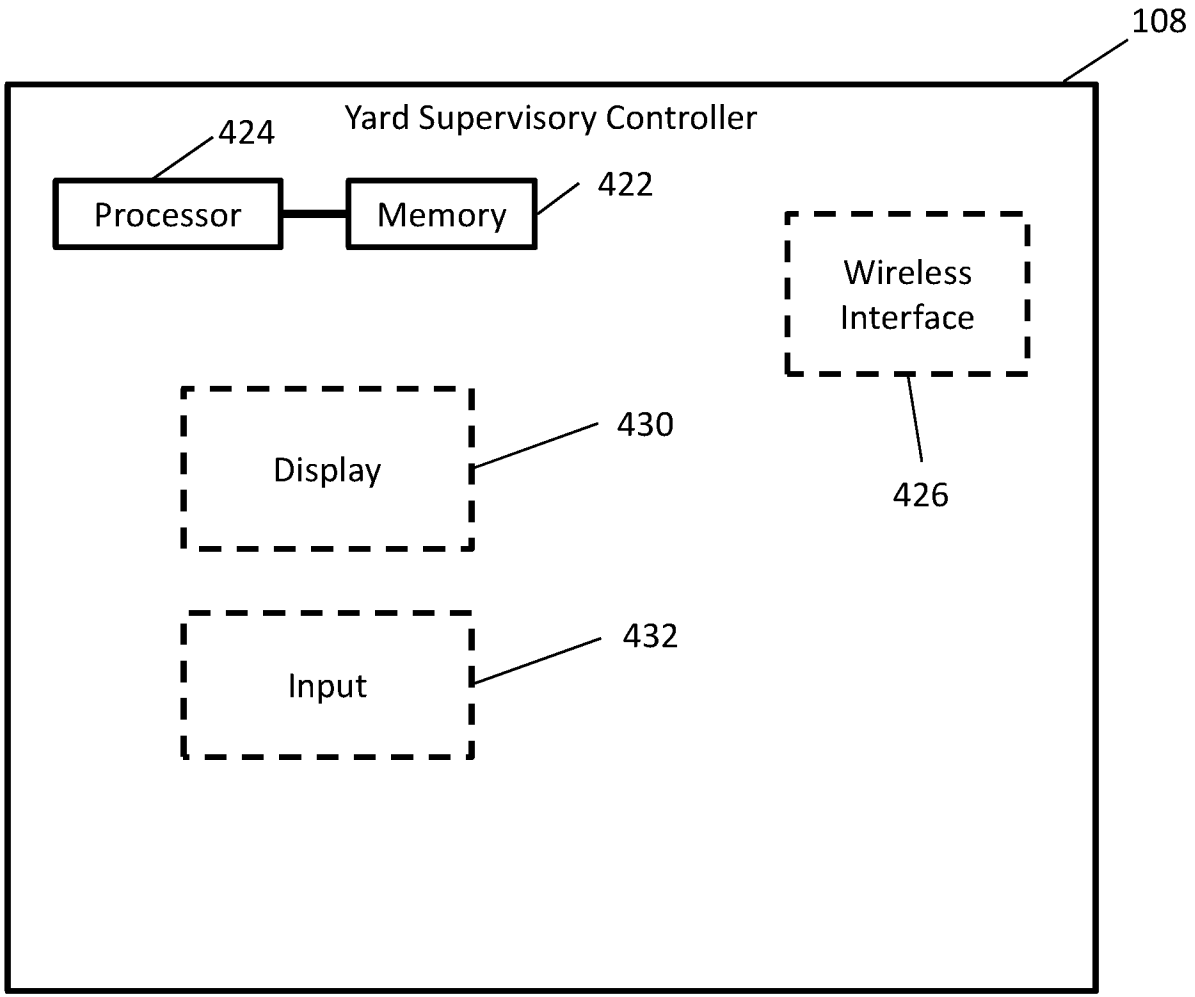
FIG. 4 is a block diagram of the yard supervisory controller of FIG. 1.

The yard supervisory controller 108 may be configured to access at least one of an intelligent video system, a virtual map of the track(s) 104, a dynamic makeup list of the locomotive consist 102, etc. For example, as shown in FIG. 4, the yard supervisory controller 108 may include a processor 424, a memory 422, a wireless interface 426 (and/or a wired interface), an input 432 and a display 430. The memory may be configured to store the virtual map, the dynamic makeup list, etc., and the processor may be configured to communicate with or operate the intelligent video system, etc.

The yard supervisory controller 108 may be configured to transmit (e.g., via the wireless interface, etc.) at least one of a planned route for the locomotive consist 102, a maximum speed of movement for the locomotive consist 102, a direction of movement for the locomotive consist 102, etc.

The yard supervisory controller 108 may be configured to transmit an alert to the field operator control unit 110 and/or the remote operator controller 112 in response to detecting a risk condition with respect to the field operator control unit 110, equipment associated with the locomotive consist 102, etc.

For example, the risk condition may include the locomotive consist 102 at least partially traversing a misaligned run-through switch, the field operator control unit 110 operating beyond a specified range for movement of the locomotive consist 102, etc.

Figure 5:
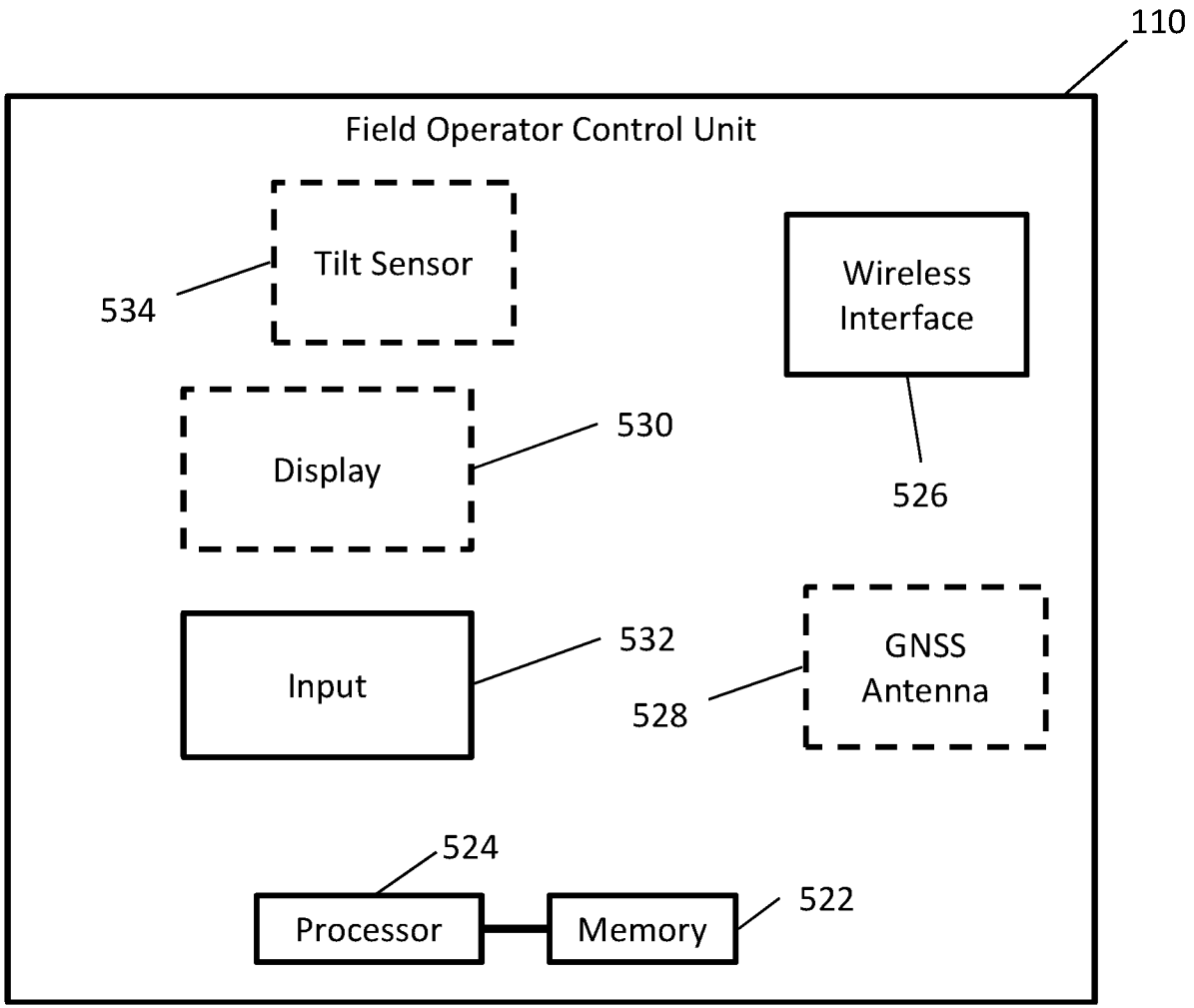
FIG. 5 is a block diagram of the field operator control unit of FIG. 1.

FIG. 5 illustrates an example embodiment of the field operator control unit 110. The field operator control unit 110 includes a memory 522 and a processor 524. The processor 524 may be configured to execute instructions stored in the memory to control movement initiation of the locomotive consist 102, to confirm a direction of movement of the locomotive consist 102, to control a speed limit of movement of the locomotive consist 102, to detect a tilt condition of the field operator control unit 110, to detect a vigilance condition of the field operator control unit 110, to stop movement of the locomotive consist 102, to initiate a spotting feature for coupling and/or uncoupling of the locomotive consist 102, etc.

The field operator control unit 110 may include a wireless interface 526 which may communicate with the locomotive controller 106 via an RF channel, etc. The field operator control unit 110 may include an optional global navigation satellite system (GNSS) antenna 528 for determining a location of the field operator control unit 110. For example, the GNSS antenna 528 may be a global positioning system (GPS) antenna.

The field operator control unit 110 may include a tilt sensor 534 (e.g., an accelerometer array, a single accelerometer, etc.) for determining a tilt condition (e.g., a fall event of a field operator 114, etc.). The field operator control unit 110 may include an enclosure (e.g., a housing) including a user interface 532, a display 530, etc.

Referring back to FIG. 1, the field operator control unit 110 may be configured to authorize movement of the locomotive consist 102 along the track(s) 104, issue a stop movement command or wait until the yard supervisory controller 108 issues a stop movement command, initiate a spotting movement of the locomotive consist 102 to couple one or more cars with the locomotive consist 102, etc.

In some embodiments, the field operator control unit 110 may be configured to determine that the locomotive consist 102 has reached a cutoff point location, issue a stop movement command or wait until the yard supervisory controller 108 issues a stop movement command, set one or more brakes of the locomotive consist 102, authorize a reverse movement to uncouple one or more cars of the locomotive consist 102, etc.

The locomotive controller 106 may be configured to receive a maximum speed order and an acceptable direction order from the yard supervisory controller 108 via the remote operator controller 112, transmit an alert to the field operator control unit 110, execute a movement of the locomotive consist 102 in response to receiving a movement initiation command from the field operator control unit 110, etc.

FIG. 1 illustrates one example embodiment of RF communication paths between the components of the system 100, and other embodiments may include different communication paths between the components. In some embodiments, the field operator control unit 110 may not be in direct communication with the yard supervisory controller 108. The locomotive controller 106 (e.g., a machine control unit (MCU), etc.) may be controlled by the field operator controller 110 and the remote operator controller 112 (e.g., a kiosk operator, etc.), depending on the situation. In some embodiments, the remote operator controller 112 may be the only device in communication with the yard supervisory controller 108. The remote operator controller 112 may be automated, may be controlled by a kiosk operator present at the remote operator controller 112, etc.

Although FIG. 1 illustrates a single locomotive consist 102 and a single field operator control unit 110, in other embodiments one remote operator controller 112 may facilitate route planning and navigation of the multiple locomotive consists operated by multiple field operator control units.

The remote operator controller 112 may be located in a location remote from the locomotive consist 102 that does not allow for visual observation of the locomotive consist 102, and the remote operator controller 112 may be configured to communicate with the locomotive controller 106 and/or the field operator control unit 110 via a wireless network connection (e.g., a radio frequency (RF) wireless connection, an Internet connection, etc.).

In some embodiments, the locomotive controller 106 may include an intelligent video processing automation system, a pullback protection automation system, etc., and the remote operator controller 112 may not be configured to monitor a pull movement point of the locomotive consist 102.

As described herein, the example locomotive controllers, field operator control units, remote operator controllers, yard supervisory controllers, etc., may include a microprocessor, microcontroller, integrated circuit, digital signal processor, etc., which may include memory. The controllers may be configured to perform (e.g., operable to perform, etc.) any of the example processes described herein using any suitable hardware and/or software implementation. For example, the controllers may execute computer-executable instructions stored in a memory, may include one or more logic gates, control circuitry, etc.

According to another example embodiment of the present disclosure, a method of controlling a locomotive consist is disclosed. The locomotive consist includes a locomotive controller located on the consist to control movement of the locomotive consist along one or more tracks.

The method includes controlling, by a field operator control unit in communication with the locomotive controller, movement of the locomotive consist via the locomotive controller, and monitoring, by a yard supervisory controller, a location of the locomotive consist along the one or more tracks.

The method also includes transmitting, by a remote operator controller in communication with the yard supervisory controller and the locomotive controller, speed and direction orders from the yard supervisory controller to the locomotive controller to control movement of the locomotive consist.

The track(s) may include at least one track switch, and the method may include controlling, by the remote operator controller, the at least one track switch to plan and line a route for movement of the locomotive consist along the track(s).

In some embodiments, the method includes setting, by the remote operator controller, a maximum stopping range for each movement of the locomotive consist, receiving, by the remote operator controller, a streaming video feed to monitor movement of the consist along the one or more tracks, and displaying, by the remote operator controller, the received video feed on a display of the remote operator controller.

The locomotive consist may include a head and a tail, and the one or more tracks include at least one axle counter positioned at a location on the track(s). The method may include monitoring, by the yard supervisory controller a location of the head of the locomotive consist, a location of the tail of the locomotive consist, a state of the at least one track switch, a location of the field operator control unit with respect to a planned route of movement of the locomotive consist, a state of the at least one axle counter, etc.

In some embodiments, the method may include accessing, by the yard supervisory controller, an intelligent video system, a virtual map of the one or more tracks, a dynamic makeup list of the locomotive consist, etc., and transmitting, by the yard supervisory controller, a planned route for the locomotive consist, a maximum speed of movement for the consist, a direction of movement for the locomotive consist, etc.

The method may include transmitting, by the yard supervisory controller, an alert to the field operator control unit and/or the remote operator controller in response to detecting a risk condition with respect to the field operator control unit and/or equipment of the locomotive consist. For example, the risk condition may include the locomotive consist at least partially traversing a misaligned run-through switch, the field operator control unit operating beyond a specified range for movement of the locomotive consist, etc.

The method may include performing, by the field operator control unit, controlling movement initiation of the locomotive consist, confirming a direction of movement of the locomotive consist, controlling a speed limit of movement of the locomotive consist, detecting a tilt condition of the field operator control unit, detecting a vigilance condition of the field operator control unit, stopping movement of the locomotive consist, initiating a spotting feature for coupling and/or uncoupling of the locomotive consist, etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein:

the one or more tracks include at least one track switch; and the remote operator controller is configured to control the at least one track switch to plan and line a route for movement of the locomotive consist along the track(s).

2. The system of claim 1, wherein the yard supervisory controller is configured to access at least one of an intelligent video system, a virtual map of the one or more tracks, and a dynamic makeup list of the locomotive consist.

3. The system of claim 1, wherein the yard supervisory controller is configured to transmit at least one of a planned route for the locomotive consist, a maximum speed of movement for the locomotive consist, and a direction of movement for the locomotive consist.

4. The system of claim 1, wherein the field operator control unit is configured to perform at least one of: controlling movement initiation of the locomotive consist, confirming a direction of movement of the locomotive consist, controlling a speed limit of movement of the locomotive consist, detecting a tilt condition of the field operator control unit, detecting a vigilance condition of the field operator control unit, stopping movement of the locomotive consist, and initiating a spotting feature for coupling and/or uncoupling of the locomotive consist.

5. The system of claim 1, further comprising multiple locomotive consists including said locomotive consist, and multiple field operator control units including said field operator control unit, wherein the remote operator controller is configured to facilitate route planning and navigation of the multiple locomotive consists operated by the multiple field operator control units.

6. The system of claim 1, wherein:

the field operator control unit is not in direct communication with the yard supervisory controller; and only the remote operator controller is in direct communication with the yard supervisory controller.

7. The system of claim 1, wherein:

the locomotive consist includes a head and a tail; and the yard supervisory controller is configured to monitor a location of the head of the locomotive consist, a location of the tail of the locomotive consist, and a state of the at least one track switch.

8. The system of claim 1, wherein:

the one or more tracks include at least one axle counter positioned at a location on the track(s); and the yard supervisory controller is configured to monitor a location of the field operator control unit with respect to a planned route of movement of the locomotive consist, and a state of the at least one axle counter.

9. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein:

the remote operator controller is configured to set a maximum stopping range for each movement of the locomotive consist;

the remote operator controller includes a display; and the remote operator controller is configured to receive and display a streaming video feed to monitor movement of the locomotive consist along the one or more tracks.

10. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein:

the one or more tracks include at least one track switch;

the locomotive consist includes a head and a tail; and the yard supervisory controller is configured to monitor a location of the head of the locomotive consist, a location of the tail of the locomotive consist, and a state of the at least one track switch.

11. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein:

the one or more tracks include at least one axle counter positioned at a location on the track(s); and the yard supervisory controller is configured to monitor a location of the field operator control unit with respect to a planned route of movement of the locomotive consist, and a state of the at least one axle counter.

12. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein:

the yard supervisory controller is configured to transmit an alert to the field operator control unit and/or the remote operator controller in response to detecting a risk condition with respect to the field operator control unit and/or equipment of the locomotive consist; and the risk condition includes at least one of the locomotive consist at least partially traversing a misaligned run-through switch, and the field operator control unit operating beyond a specified range for movement of the locomotive consist.

13. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein the field operator control unit is configured to:

authorize movement of the locomotive consist along the track(s);

issue a stop movement command or wait until the yard supervisory controller issues a stop movement command; and initiate a spotting movement of the locomotive consist to couple one or more cars with the locomotive consist.

14. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein the field operator control unit is configured to:

determine that the locomotive consist has reached a cutoff point location;

issue a stop movement command or wait until the yard supervisory controller issues a stop movement command;

set one or more brakes of the locomotive consist; and authorize a reverse movement to uncouple one or more cars of the locomotive consist.

15. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein the locomotive controller is configured to:

receive a maximum speed order and an acceptable direction order from the yard supervisory controller via the remote operator controller;

transmit an alert to the field operator control unit; and in response to receiving a movement initiation command from the field operator control unit, execute a movement of the locomotive consist.

16. A locomotive consist control system, comprising:

a locomotive controller located on a locomotive consist to control movement of the locomotive consist along one or more tracks;

a field operator control unit in communication with the locomotive controller, the field operator control unit configured to control movement of the locomotive consist via the locomotive controller;

a yard supervisory controller configured to monitor a location of the locomotive consist along the one or more tracks; and a remote operator controller in communication with the yard supervisory controller and the locomotive controller, the remote operator controller configured to transmit speed and direction orders from the yard supervisory controller to the locomotive controller to control movement of the locomotive consist;

wherein the remote operator controller is located in a location remote from the locomotive consist that does not allow for visual observation of the locomotive consist, and the remote operator controller is configured to communicate with the locomotive controller and/or the field operator control unit via a wireless network connection.

17. A method of controlling a locomotive consist, the locomotive consist including a locomotive controller located on the locomotive consist to control movement of the locomotive consist along one or more tracks, the method comprising:

controlling, by a field operator control unit in communication with the locomotive controller, movement of the locomotive consist via the locomotive controller;

monitoring, by a yard supervisory controller, a location of the locomotive consist along the one or more tracks; and transmitting, by a remote operator controller in communication with the yard supervisory controller and the locomotive controller, speed and direction orders from the yard supervisory controller to the locomotive controller to control movement of the locomotive consist;

wherein:

the one or more tracks include at least one track switch; and the method further comprises controlling, by the remote operator controller, the at least one track switch to plan and line a route for movement of the locomotive consist along the track(s).

18. The method of claim 17, further comprising:

setting, by the remote operator controller, a maximum stopping range for each movement of the locomotive consist;

receiving, by the remote operator controller, a streaming video feed to monitor movement of the locomotive consist along the one or more tracks; and displaying, by the remote operator controller, the received video feed on a display of the remote operator controller.

19. The method of claim 18, wherein the locomotive consist includes a head and a tail, and the one or more tracks include at least one axle counter positioned at a location on the track(s), and the method further comprises:

monitoring, by the yard supervisory controller, a location of the head of the locomotive consist, a location of the tail of the locomotive consist, a state of the at least one track switch, a location of the field operator control unit with respect to a planned route of movement of the locomotive consist, and a state of the at least one axle counter.

20. The method of claim 17, further comprising:

the field operator control unit is not in direct communication with the yard supervisory controller; and only the remote operator controller is in direct communication with the yard supervisory controller.

* * * * *